US008752672B2

(12) United States Patent
Turner

(10) Patent No.: US 8,752,672 B2
(45) Date of Patent: Jun. 17, 2014

(54) LADDER STANDOFF DEVICE

(76) Inventor: Christopher D. Turner, Bardstown, KY (US)

( * ) Notice: Subject to any disclaimer, the term of this patent is extended or adjusted under 35 U.S.C. 154(b) by 172 days.

(21) Appl. No.: 12/807,450

(22) Filed: Sep. 7, 2010

(65) Prior Publication Data

US 2012/0055739 A1 Mar. 8, 2012

(51) Int. Cl.
*E06C 7/00* (2006.01)

(52) U.S. Cl.
USPC ..... 182/214; 182/107

(58) Field of Classification Search
USPC ..... 182/107, 214, 229
See application file for complete search history.

(56) References Cited

U.S. PATENT DOCUMENTS

| | | | | | |
|---|---|---|---|---|---|
| 543,513 | A | * | 7/1895 | Somers | 248/238 |
| 1,567,447 | A | * | 12/1925 | McCracken | 182/164 |
| 2,203,445 | A | | 6/1940 | Schwarz et al. | |
| 3,072,218 | A | * | 1/1963 | Peters | 182/214 |
| 3,459,277 | A | * | 8/1969 | Frederick | 182/214 |
| 3,653,462 | A | | 4/1972 | Courtney | |
| 3,693,756 | A | | 9/1972 | Walker et al. | |
| 3,713,510 | A | | 1/1973 | O'Dell | |
| 3,853,202 | A | | 12/1974 | Jarboe | |
| 4,164,269 | A | | 8/1979 | Jackson | |
| 4,280,590 | A | | 7/1981 | Polizzi | |
| 4,331,217 | A | * | 5/1982 | Stecklow | 182/214 |
| 4,369,860 | A | | 1/1983 | Beane | |
| 4,502,566 | A | | 3/1985 | Wing | |
| 4,580,661 | A | | 4/1986 | Thomson, Jr. | |
| 4,615,412 | A | * | 10/1986 | Clarke | 182/214 |
| 4,714,136 | A | | 12/1987 | Morin | |
| 4,742,888 | A | * | 5/1988 | Amacker | 182/116 |
| 4,771,862 | A | | 9/1988 | Garland | |
| 4,787,478 | A | | 11/1988 | Stakes | |
| 4,823,912 | A | | 4/1989 | Gould et al. | |
| 5,117,941 | A | | 6/1992 | Gruber | |
| 5,121,814 | A | * | 6/1992 | Southern | 182/214 |
| 5,165,501 | A | * | 11/1992 | Donahey | 182/214 |
| 5,215,163 | A | | 6/1993 | Kent, Sr. et al. | |
| 5,261,507 | A | * | 11/1993 | Williams et al. | 182/214 |
| 5,373,913 | A | * | 12/1994 | Santos | 182/107 |
| 5,460,241 | A | | 10/1995 | LaBelle | |
| 5,497,848 | A | | 3/1996 | Travis | |

(Continued)

OTHER PUBLICATIONS

Acro Building Systems Ladder Stand Off #11710, at http://www.industrialladder.com printed on May 21, 2012.

*Primary Examiner* — Katherine Mitchell
*Assistant Examiner* — Daniel Cahn
(74) *Attorney, Agent, or Firm* — Carrithers Law Office PLLC

(57) ABSTRACT

A standoff device and ladder designed for positioning with respect to a supporting structure, the standoff is temporarily and rigidly attached to the upper end of a ladder for the purpose of holding the ladder away from the structure against which the ladder is leaning to provide more stability and a comfortable distance between the user and the structure during tasks such as painting, power washing a house, working with gutters, carpentry, roofing, tree trimming and pruning. The standoff comprises a pivotal frame which is moveably and adjustably secured to a selected rung of the ladder with the pivotal movement limited by a chain, rope, strap, strut, telescoping member, or other holding element attached to a lower portion of the ladder such as a lower rung. The standoff device includes a frame having extendable legs with padded rollers journalled on the end in a "V-shape" for leaning against various shapes of vertical support structures such as walls of a building, columns or trees.

2 Claims, 5 Drawing Sheets

(56) References Cited

U.S. PATENT DOCUMENTS

| | | | | |
|---|---|---|---|---|
| 5,509,500 | A | 4/1996 | Delagera | |
| 5,549,261 | A | 8/1996 | Hardin | |
| 5,628,381 | A | 5/1997 | Markovich et al. | |
| 5,833,028 | A | 11/1998 | Ramsey et al. | |
| 5,850,894 | A * | 12/1998 | Busenhart | 182/214 |
| 5,855,252 | A | 1/1999 | Vrolyks | |
| 5,966,875 | A | 10/1999 | Kuhns | |
| 6,009,974 | A | 1/2000 | Jones | |
| 6,152,262 | A | 11/2000 | Jung | |
| 6,250,424 | B1 * | 6/2001 | Laug | 182/107 |
| 6,354,401 | B2 | 3/2002 | Murray | |
| 6,408,983 | B1 | 6/2002 | Widurski | |
| 6,578,665 | B1 | 6/2003 | Debaca et al. | |
| 6,681,893 | B1 * | 1/2004 | Coulson | 182/107 |
| 6,691,825 | B2 * | 2/2004 | Haig | 182/107 |
| 6,691,829 | B1 | 2/2004 | Stelmach | |
| 6,745,870 | B2 | 6/2004 | Smith | |
| 7,377,360 | B1 | 5/2008 | Misiak | |
| 2002/0125070 | A1 | 9/2002 | Brown | |
| 2003/0201139 | A1 * | 10/2003 | Haig | 182/107 |
| 2005/0029046 | A1 | 2/2005 | Royce | |
| 2005/0115766 | A1 | 6/2005 | Corston | |
| 2005/0126855 | A1 | 6/2005 | Tiley | |
| 2006/0054390 | A1 | 3/2006 | Ray | |
| 2006/0054391 | A1 | 3/2006 | Tilley | |
| 2010/0326770 | A1 * | 12/2010 | Clifford | 182/214 |

* cited by examiner

LADDER STANDOFF DEVICE

TECHNICAL FIELD

The present invention relates to the field of devices which are attached to a ladder to hold the upper end of the ladder away from a structure against which the ladder is leaned, thereby protecting the surface of the structure and other attachments, for example, gutters, providing increased stability for the ladder and the user, and providing a comfortable distance between the user and the structure during such tasks as painting or power washing.

DESCRIPTION OF THE RELATED ART

Ladders placed against any given structure have always posed a stability problem. Instability is even more of an issue when the ladder is to be used on the corner of a structure, a pole or tree, or near a window where there is often insufficient surface on which to support the rails. Further, a tall ladder or an extension ladder poses additional difficulties during use and also when positioning the ladder before use due to the awkwardness associated with moving a ladder which is three or more times as tall as the user. When an extension ladder must be extended upward, the user usually either pulls a rope to raise the upper portion of the ladder or the user pushes the upper portion up one rung at a time. With a standoff device attached to the upper portion of a ladder which is leaning against a structure, the weight of the ladder and the standoff will tend to hold the standoff against the structure. Consequently, the standoff device attached to the upper portion of the ladder would tend to catch on the structure against which the ladder leans as the combination is raised upward. Another problem with ladders which are leaned against a structure is that a user climbing to the top of the ladder will be too close to the structure to comfortably perform a desired task such as painting, cleaning, or doing needed structural repairs. A variety of devices have been developed that have attempted to solve these problems.

In U.S. Pat. No. 5,121,814, Southern teaches a ladder standoff which hold the ladder away from a structure against which the ladder is leaned. The brackets are attached to the upper rails of a ladder and may be broadened or narrowed as needed to increase ladder stability. The problems with Southern include poor and cumbersome means of attachment to the ladder, difficulty with adjustment from wide to narrow bracket configuration and difficulty of raising or lowering of the ladder and standoff when the ladder is an extension ladder.

In US Patent Application Publication No. 2003/0201139, Haig teaches a ladder standoff and stabilizer with a more rigid means of attachment to the ladder as compared to Southern, but which requires a great deal of time to perform the attachment. An additional problem is that in order to reconfigure the standoff from flat surface usage to corner usage, Haig must be disassembled and then reassembled, requiring more time and labor. Further, the difficulty of raising or lowering the ladder and standoff when used on an extension ladder presents another weakness.

U.S. Pat. No. 5,833,028 by Ramsey et al. teaches a roller attachment for ladders in which two shells, each with a roller journalled on the distal end thereof, are assembled onto the upper ends of the rails of a ladder. Ramsey does not provide any additional lateral stability, since the rollers simply extend directly upward from the ends of the ladder rails. Further, Ramsey does not provided for usage of the ladder against a corner of a structure, a pole or a tree.

SUMMARY OF THE INVENTION

None of these conventional standoff devices teach a ladder standoff device for use on the top portion of a ladder which can be quickly and easily attached and detached and which increases the stability of the ladder during use by widening the area of contact between the ladder and a selected structure. This standoff includes members which improve stability when the ladder is used against an outside corner of a structure or against a pole or a tree. Further, the standoff includes rollers which roll against the structure while the user extends or retracts an extension ladder to which the standoff is attached, therefore easing the task of raising or lowering the ladder which is leaning against a structure. The rollers are made of a non-slip, compressible material such as open or closed cell foam rubber, neoprene, or other polymer which further improve stability of the ladder when used against surfaces which may tend to be slick and prevent marring or scraping of structural surfaces. The standoff device is adjustable so that the distance at which the ladder is held from a structure may be changed as desired, thus providing a comfortable selected position for performing various tasks such as painting, cleaning or performing selected repairs to a given structure. Additionally, the standoff can be configured on the ladder to protect structural members such as gutters or windows by preventing contact between the ladder and these members, while still providing improved stability for the ladder and the user.

In keeping with the invention presented in this application there is provided a ladder including two rails connected by a plurality of parallel rungs, and a ladder positioning and stabilizing device defining a ladder standoff device used to hold and stabilize the ladder at a selected distance from a structure. The standoff device comprises, consists essentially of and/or consists of a frame having ladder attachment portion and a base support portion. The ladder attachment portion of the frame includes a pair of parallel first longitudinal members or arms extending from the ladder to the base support forming a generally square frame with a outer frame brace member and an inner frame brace member spaced apart parallel from one another between and toward the distal ends of the arms. A pair of longitudinal ladder rail support or stop members extend outwardly perpendicularly from the distal ends of the arm adjacent to and parallel with the ladder rungs for cooperative engagement with the bottom portion of the ladder rails. Each arm includes a rung holding means comprising a rung embracing curved "C-shaped" member attached to the distal ends of the arm positioned on the side of the arm facing the ladder supporting structure whereby the distal ends of the arms can extend through and between the rungs of the ladder to a point where the stop members abut the lower rail surface and the "C-shaped" member partially surrounds and abuts the rung disposed immediately above the stop members. A hook member is pivotally connected to the outer brace member and position able to pivot and cooperatively engage the same rung of the ladder disposed immediately above the stop members which cradled by the "C-shaped" member. As best shown in FIG. 7, the "C-shaped" members exert an upward force on the rung while the hook member exerts a downward force upon the rung to securely attach the ladder standoff frame to the ladder. The two longitudinal stop members perpendicularly attached on the outer edges of the first members or arms are proximate to the curved members. The stop members are positioned to cause the stabilizer to remain approximately perpendicular to the rails of the ladder as the curved members and the hook member embrace the rung. A proximal one of the second members or more particularly the inner brace member has a clip attached thereto. The free end of the clip has a chain attached with a snap hook attached to the free end in order that the chain can extend from the inner brace member below the rung supporting the frame to an adjacent rung below the frame holding rung, or preferably the chain can extend over a rung below the frame holding rung and be attached a lower rung. The angle of the ladder standoff frame with respect to the ladder and the support structure is determined by the selection of the length of the chain.

The base support member includes an inverted U-shaped frame member which includes a pair of spaced apart parallel fifth longitudinal members extending perpendicularly and co-planar from the upper outer edge of the U-shaped frame member. The fifth members coaxially engage the distal ends of the first members or arms and both contain a plurality of spaced corresponding holes alignable with one another allowing for insertion of the fifth members into the first tubular members or vise visa providing an adjustable and telescoping arm. This allows the first aperture to align with a selected one of the second apertures whereupon a pin is inserted for holding the ladder attachment frame portion in a selected position with respect to the base member providing means to adjust the distance the ladder is held away from the support structure.

Extending perpendicular to and co-planar with the ends of the "U-shaped" frame member is a pair of fourth longitudinal roller members each one having at least one roller coaxially journal led thereon. As best shown in FIGS. 4-9, the outer portion of the third roller members extending past the "U-shaped" frame member supports a roller perpendicular to the ladder for rolling up and down the support structure. The inner portion of the third roller members extending inwardly toward and coplanar with the center of the "U-shaped" frame are formed having an obtuse angle of preferably between 130 and 140 degrees providing. At least one roller is supported on each end of the inner portion providing a "V-shaped" support structure for supporting the standoff device against the corner of a structure, column, or tree.

It is an object of this invention to provide a ladder standoff device which provides a wider area of contact between the ladder and the structure against which the ladder is leaning, thus providing improved stability for the ladder and the user.

It is an object of the present invention to provide rollers extending from the standoff frame to ease the task of extending or retracting the upper portion of the extension ladder in that the rollers can roll freely against that rough surface of the structure as the ladder is extended or retracted rather than the upper free ends of the ladder dragging and catching on the rough surface of a structure against which the ladder leans.

It is another object of the present invention to provide a standoff device that can be easily, quickly and securely attached to any straight ladder.

It is another object of the present invention to provide a standoff device for a ladder that prevents the ladder from slipping once set in place whether against a flat wall or corner.

A further object of the present invention is to provide a standoff device for ladders that can be used against most vertical surfaces and can span various structural variations such as windows and corners without reconfiguring of the standoff in any way.

Another object of the present invention is to provide a standoff device for ladders which includes rollers which roll against the structure while the user extends or retracts an extension ladder to which the standoff is attached, therefore easing the task of raising or lowering the ladder which is leaning against a structure.

Another object of the present invention is to provide a standoff device for ladders which includes rollers for contacting the surface of a selected structure which are made of a no-slip, compressible material, such as foam rubber, which further improve stability of the ladder when used against surfaces which may tend to be slick and which prevent marring or scraping of structural surfaces.

It is another object of the present invention to provide a standoff device for ladder that is adjustable so that the distance at which the ladder is held from a structure may be changed as desired, thus providing a comfortable selected position for performing various tasks such as painting, cleaning or performing selected repairs to a given structure.

A further object of the present invention is to provide a standoff device for ladders that can hold a ladder securely against a tree or column without reconfiguring of the standoff in any way.

A further object of the present invention is to provide a standoff device for ladders that is inexpensive to manufacture and can be manufactured using readily available materials.

Thus the standoff device includes means for attachment to a portion of the ladder side rails and a selected rung on one end, and an opposing end including a roller support assembly including a pair of spaced apart bars.

Furthermore, the present invention provides a ladder standoff device for positioning a ladder with respect to a supporting structure which is temporarily and rigidly attached to the upper end of a ladder for the purpose of holding the ladder away from the structure against which the ladder is leaning to provide more stability and means to provide a comfortable distance between the user and the structure during tasks such as painting, power washing house frame and sidings, and for the installation and cleaning of gutters, for carpentry, roofing, tree trimming and pruning. The standoff is easily and quickly secured to a selected rung of the ladder preferably a top rung or rung near the top. The standoff comprises a pivotal frame which is moveably and adjustably secured to a selected rung of the ladder with the pivotal movement limited by chain, rope, strap, strut, telescoping member, or other holding means attached to a lower portion of the ladder such as a lower rung. The standoff device includes a frame having extendable legs having padded rollers journal led on the end thereof which contact the structure. Moreover, an additional pair of rollers extend inwardly from the legs form a "V-shaped" support means for leaning against vertical support structures such as columns or trees. The rollers are covered with a non-slip, compressible material which conforms to and tends to grip the surface of a structure so that the ladder and standoff assembly is more secure and stable during use. The frame includes other rollers journal led inwardly at selected obtuse angles so that the frame is configured for use against the outside or inside corner of a structure, a pole or a tree. The rollers make easier work of standing the ladder up against a structure or adjusting the angle of the ladder relative to the structure by supporting the upper section of the ladder while the base of the ladder is lifted and spaced apart from the structure to obtain the optimal angle for the ladder to rest against the structure. Further, when used on an extension ladder, the rollers make an easier task of raising or lowering the ladder by allowing the rollers to roll against the structure as the ladder is extended upward or retracted downward. The padded rollers also protect the surface of any structure against which the ladder is leaned from being marred, scratched or crushed by the ladders legs, and increases the surface are of the ladder in contact with the supporting structure for dissipating the weight.

BRIEF DESCRIPTION OF THE DRAWINGS

A better understanding of the present invention will be had upon reference to the following description in conjunction with the accompanying drawings in which like numerals refer to like parts throughout the views wherein.

DESCRIPTION OF THE PREFERRED EMBODIMENTS

In accordance with the present invention, there is provided a standoff device for use on a straight ladder, that is, a ladder designed to lean against a structure as opposed to a self supporting step ladder.

Figure 1:
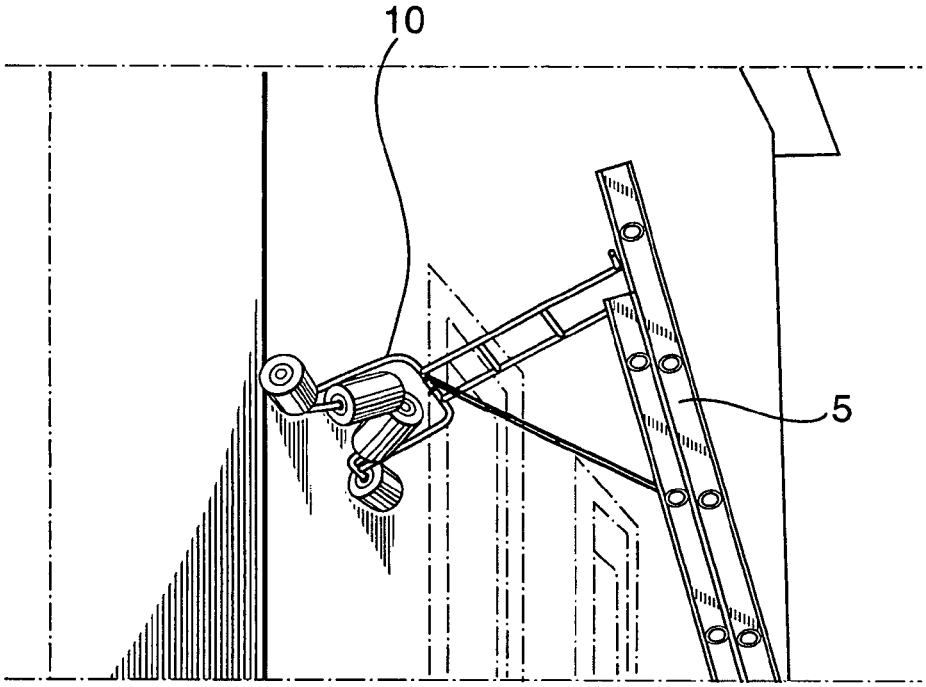
FIG. 1 is a perspective view of a ladder standoff attached to a ladder and leaning against a stone structure.
Figure 2:
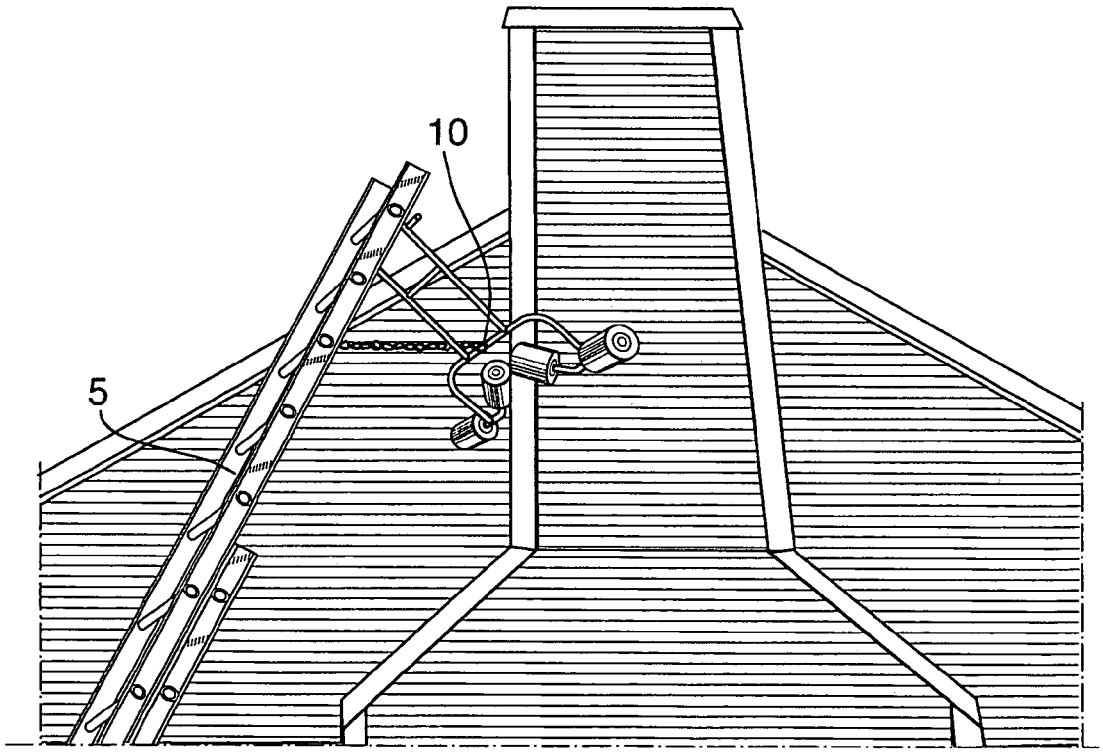
FIG. 2 is a perspective view of a ladder standoff attached to a ladder and leaning against the corner of a chimney.
Figure 3:
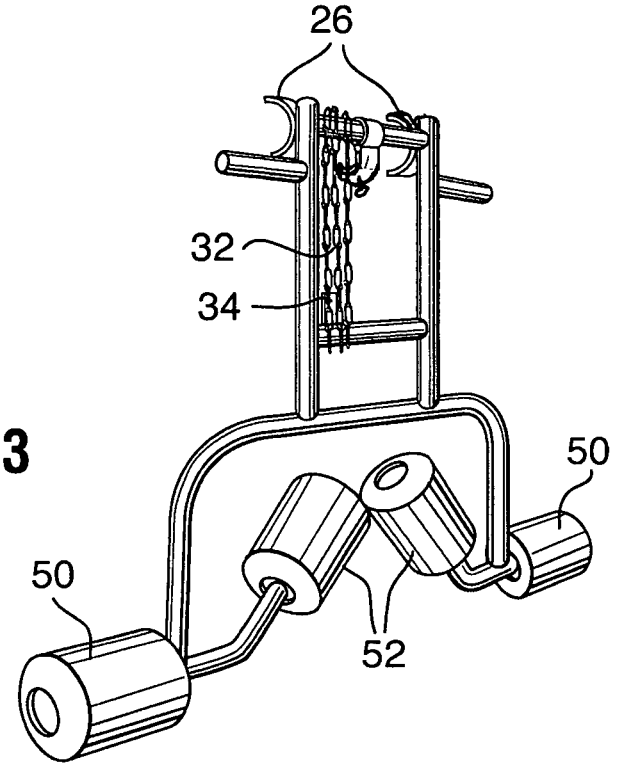
FIG. 3 is a perspective view of a ladder standoff.

FIGS. 1-3 shows the ladder standoff device 10 including a ladder embracing, square frame member 20 and a base frame member 15. Base member 15 includes a U-shaped member 59 with members 64 permanently attached perpendicular to the distal ends 60 and 62 of the U-shaped member 59. The inner portion of member 64 are bent at an obtuse angle 57 of preferably between 130-140 degrees and more preferably at about 135 degrees providing. A roller 52 is journalled coaxially on portion 56 of members 64. A roller 50 is journalled coaxially on portion 54 of members 64. Rollers 50 and 52 are covered with a pliable, compressible and non-skid material such as foam rubber or an elastomeric material.

Figure 4:
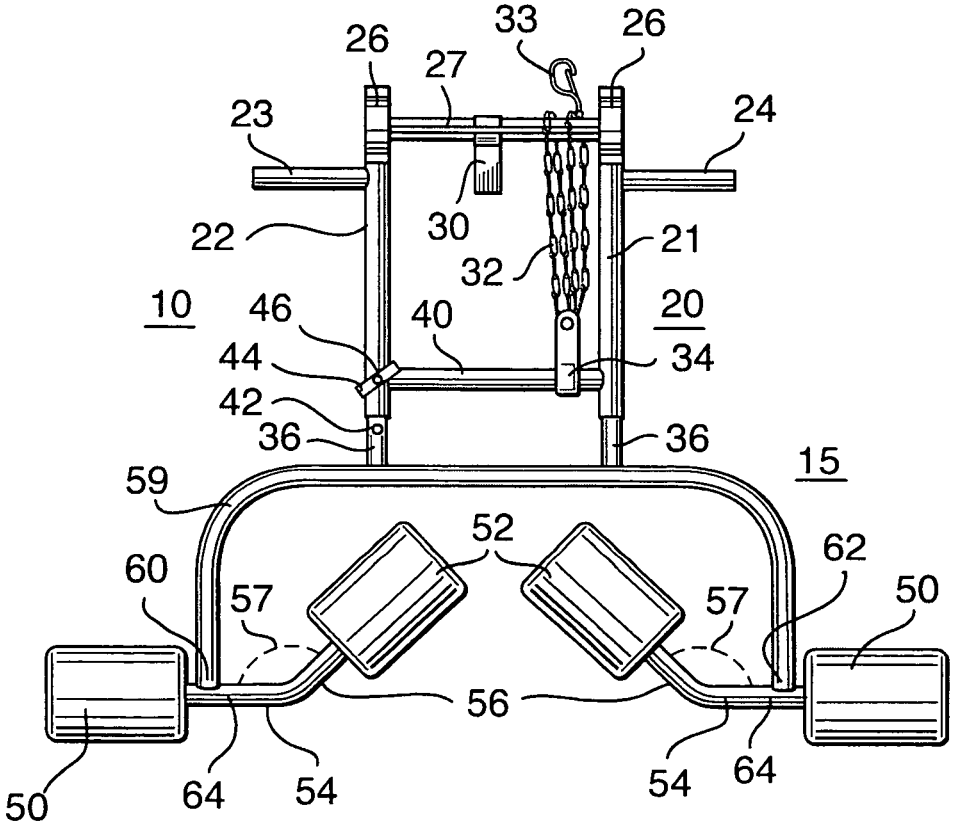
FIG. 4 is a top view of the ladder standoff.
Figure 5:
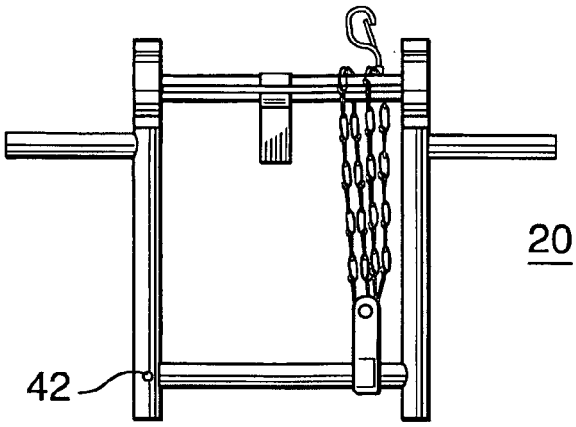
FIG. 5 is a top view of the ladder embracing, square portion of the ladder standoff.
Figure 7:
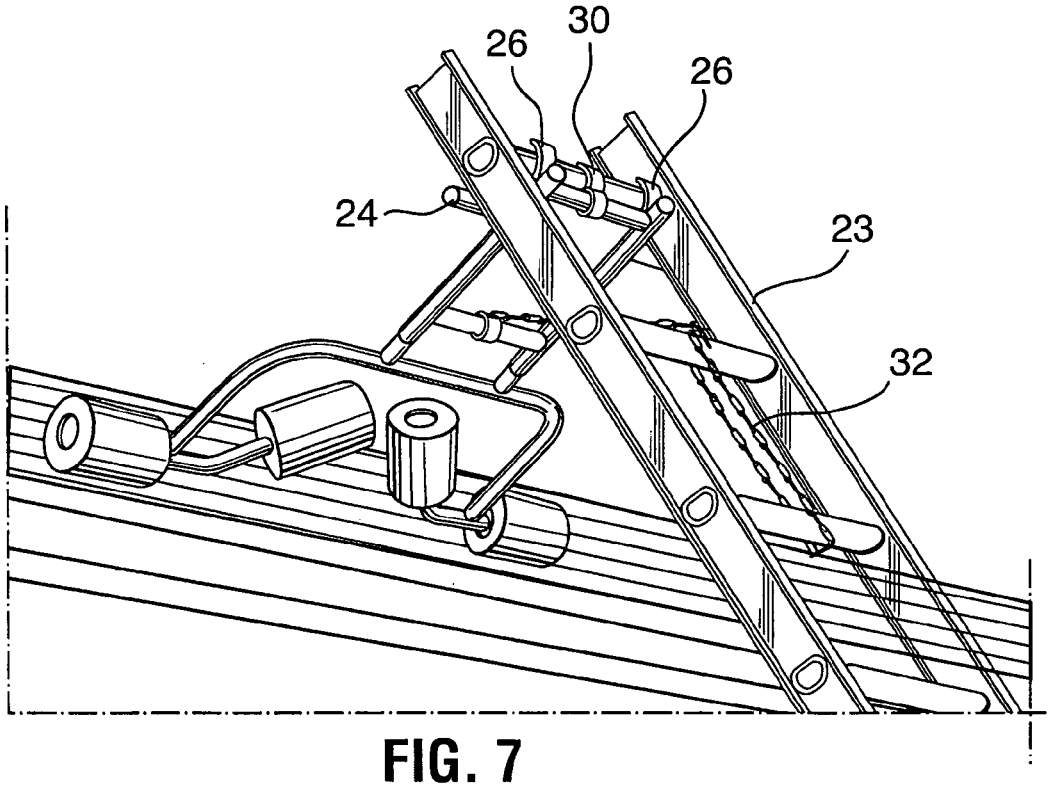
FIG. 7 is a perspective side view of a ladder standoff attached to a ladder and leaning against a roof.
Figure 8:
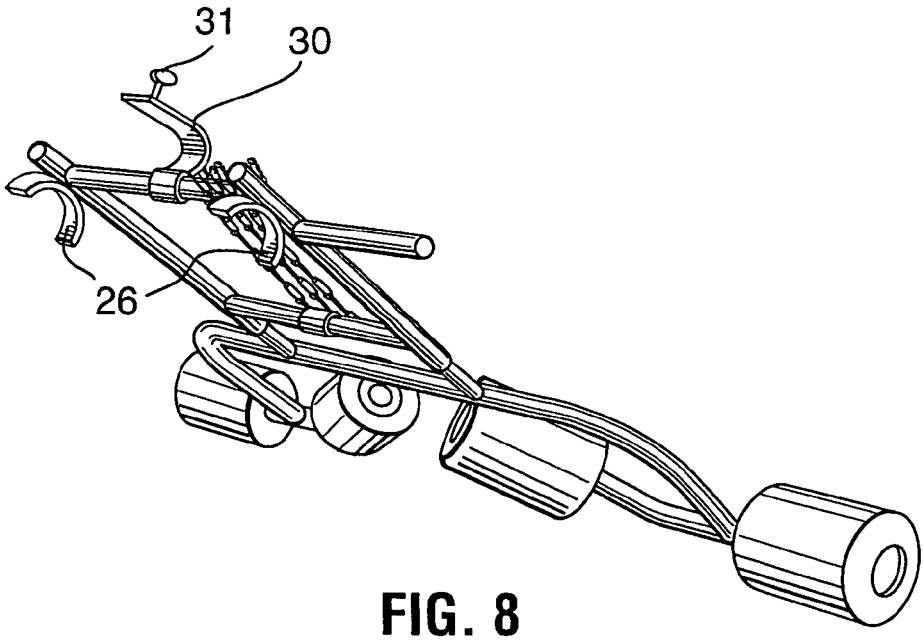
FIG. 8 is a perspective view from the upper right corner of a ladder standoff.

FIG. 5 shows the ladder embracing square member 20. Member 20, as illustrated in FIG. 4, includes parallel tubular longitudinal members 21 and 22 which slide over members longitudinal 36 of base member 15 in a telescoping fashion. Parallel longitudinal members 27 and 40 are permanently attached perpendicular to parallel members 21 and 22, thus forming a square. Member 22 contains an aperture 42 near the junction with member 40. As shown in FIGS. 3 and 7, curved members 26 are permanently attached to the distal edges of members 21 and 22. Hook member 30 is pivotally attached to member 27. As shown in FIG. 7, curved members 26 embrace the bottom side of a selected rung, preferably a top rung, of a ladder 5. Then hooked member 30 is rotated around and locked onto the rung by tightening screw 31 (shown in FIG. 8). Thus, the rung is snugly held by curved members 26 and hook member 30. Longitudinal members 23 and 24 are permanently attached perpendicular to the outer edges of members 22 and 21 respectively. Members 23 and 24 are stops and prevent ladder stabilizer 10 from rotating downward so that stabilizer 10 remains approximately perpendicular to the rails of ladder 5. A chain 32, has one end connected to member 40 by a clip 34. To prevent stabilizer 10 from rotating upward with respect to ladder 5, the free end of chain 32 contains a snap hook member 33. Chain 32 is stretched downward and the free end is wrapped around a lower rung and the snap hook 33 is fastened to a link in chain 32.

Figure 6:
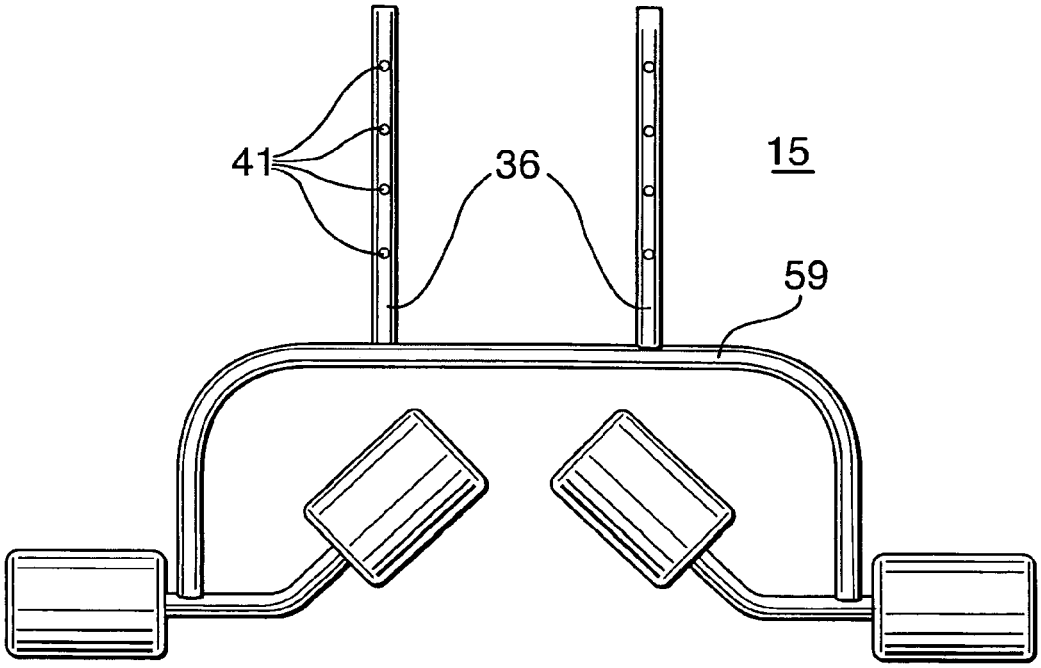
FIG. 6 is a top view of the base portion of the ladder standoff.

As shown in FIG. 6, base member 15 includes frame members and rollers. Parallel members 36 extend from the outer edge of U-shaped member 59. One or both members 36 contain a plurality of apertures. Members 36 slide into tubular members 21 and 22. Aperture 42 in member 22 is aligned with a selected one of apertures 41 in member 36 and a pin 46 is inserted to hold square member 20 in a selected telescoping position with respect to base member 15, thus setting a fixed distance at which ladder 5 may be held from a given structure.

It is anticipated that chain 32 could be replaced with a cable, rope, wire or a rigid arm. It is further anticipated that the frame members could be round or square tubular stock, aluminum, steel, fiberglass, or other appropriately strong and light materials.

As shown in FIG. 2, angled members 64 cause rollers 52 to embrace the corner of a structure, thus stabilizing the ladder when used against a corner. Non-skid rollers 50 tend to keep stabilizer 10 from slipping on surfaces such as stone (FIG. 1), wood (FIG. 2), shingles (FIG. 7), and so forth.

Figure 9:
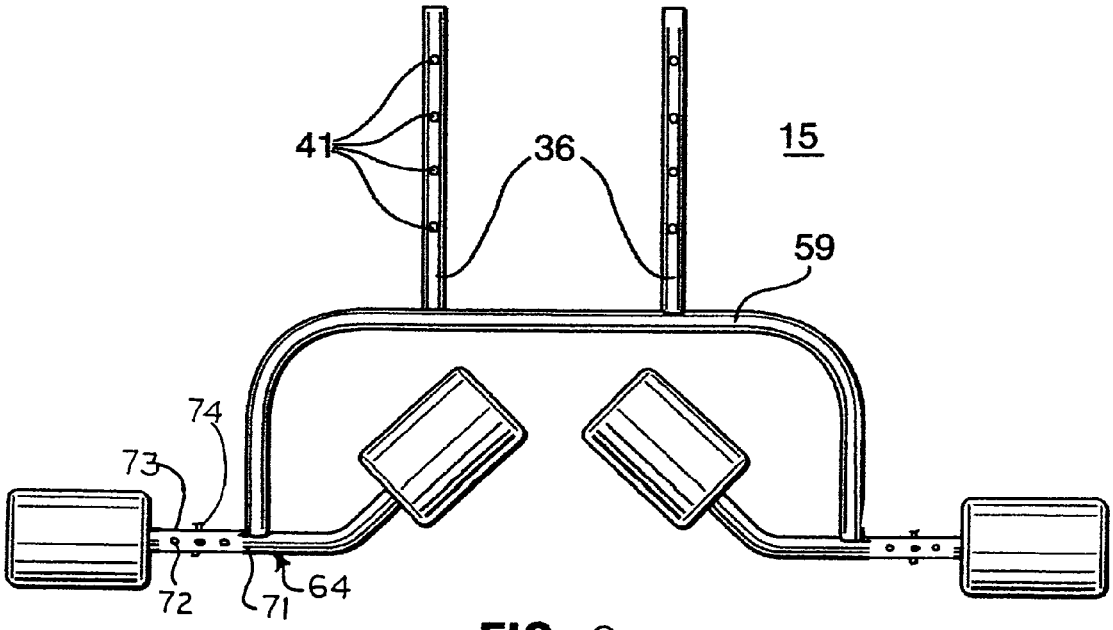
FIG. 9 is a perspective view of the ladder standoff of FIG. 6 showing extendable or telescoping adjustable legs members.

As illustrated in FIG. 9, The fourth members can be formed as a single longitudinal member 64 or consists of a pair of coaxial longitudinal tubes 71 and 73 containing a plurality of spaced corresponding holes 72 alignable with one another allowing for insertion of cooperatively engageable telescoping tubes and retaining pins 74 providing an adjustable and telescoping arm for supporting a plurality of rollers. This allows the first aperture to align with a selected one of the second apertures whereupon a pin is inserted for holding the rollers at a selected distance from the frame providing means to adjust the distance the ladder rollers are held away from the ladder.

The foregoing detailed description is given primarily for clearness of understanding and no unnecessary limitations are to be understood therefrom, for modification will become obvious to those skilled in the art upon reading this disclosure and may be made upon departing from the spirit of the invention and scope of the appended claims. Accordingly, this invention is not intended to be limited by the specific exemplification presented herein above. Rather, what is intended to be covered is within the spirit and scope of the appended claims.

We claim:

1. A ladder in combination with a ladder stand-off stabilizer, the ladder stand-off stabilizer consisting of:

a rung embracing square frame member, said square frame member including two parallel spaced apart first longitudinal tubular members permanently and directly attached to two parallel spaced apart second longitudinal cross members positioned transverse to said first longitudinal tubular members, said first longitudinal tubular members and said second longitudinal cross members forming said rung embracing square frame member; and two C-shaped rung embracing curved members respectively having a center of a major longitudinal length, each of said centers respectively connected directly to a major length of each of the first longitudinal tubular members at a respective distal end of said first longitudinal tubular members, said C-shaped rung embracing curved members coaxial to one another and respectively extending perpendicular to said first longitudinal members; and a rung embracing hook member pivotally and directly connected to a distal one of said second longitudinal cross members, said rung embracing hook member having a first section substantially encircling a circumference of the distal one of said second longitudinal cross members and the hook member having a second curved section having a tightening screw so that said hook member is capable of being rotated around and locked onto a rung of the ladder; and two stop members, each one of said two stop members respectively connected directly to and extending perpendicularly from an outer edge of each of the major lengths of the first longitudinal tubular members at a location proximate to a respective one of said rung embracing curved members, said two stop members being for cooperatively engaging a rail of the ladder and positioned to hold the stand-off stabilizer approximately perpendicular to the rail of the ladder while each of said C-shaped rung embracing curved members and said rung embracing hook member embrace the rung; and a clip directly attached to a proximal one of said second longitudinal cross members, a free end of said clip directly attached to a first end of a chain, said chain having a second end directly attached to a snap hook; and a base member including an inverted U-shaped frame member having a major length extending between two U-shaped frame ends, the base member including a pair of obtuse angled cross members respectively having a medial portion attached directly to a respective one of said U-shaped frame ends, each one of said pair of obtuse angled cross members having a linear inner portion directly attached to a linear outer portion to form an obtuse angle, each respective one of said inner portions angled inwardly toward one another and said U-shaped frame member with respect to said outer portions, each respective one of said inner and outer portions coaxially journalled to a compressible roller in order to roll freely against a surface of a structure, said obtuse angled cross members being co-planar with said U-shaped frame member; and said base member having at least one pin and a pair of spaced apart parallel longitudinal extension members, said extension members directly attached perpendicularly to and co-planar with said inverted U-shaped frame member, said extension members telescopically extend within said first longitudinal tubular members for slidable telescoping engagement, said first longitudinal tubular members and said longitudinal extension members respectively have a plurality of parallel apertures capable of aligning in order to insert said at least one pin therethrough to hold said square frame member in a selected positions with respect to said base member.

2. The ladder and stand-off stabilizer of claim 1, wherein the compressible rollers can be made from a foam rubber or an elastomeric material.

* * * * *